US012104295B2

(12) United States Patent
Kim et al.

(10) Patent No.: US 12,104,295 B2
(45) Date of Patent: Oct. 1, 2024

(54) SECURITY FABRIC HAVING IMPROVED SECURITY AND IDENTIFICATION PROPERTIES

(71) Applicant: KOREA MINTING, SECURITY PRINTING & ID CARD OPERATING CORPORATION, Daejeon (KR)

(72) Inventors: Hong Keon Kim, Daejeon (KR); Hyun Jun Kim, Sejong-si (KR); Il Hoon Choi, Daejeon (KR); Hyun Jin Oh, Sejong (KR)

(73) Assignee: KOREA MINTING, SECURITY PRINTING & ID CARD OPERATING CORPORATION, Daejeon (KR)

( * ) Notice: Subject to any disclaimer, the term of this patent is extended or adjusted under 35 U.S.C. 154(b) by 0 days.

(21) Appl. No.: 17/925,785

(22) PCT Filed: Jul. 1, 2021

(86) PCT No.: PCT/KR2021/008367
§ 371 (c)(1),
(2) Date: Nov. 16, 2022

(87) PCT Pub. No.: WO2022/050546
PCT Pub. Date: Mar. 10, 2022

(65) Prior Publication Data

US 2023/0220592 A1 Jul. 13, 2023

(30) Foreign Application Priority Data

Sep. 3, 2020 (KR) ..... 10-2020-0112204

(51) Int. Cl.
*D03D 15/547* (2021.01)
*D03D 1/00* (2006.01)
*D03D 13/00* (2006.01)

(52) U.S. Cl.
CPC ..... *D03D 15/547* (2021.01); *D03D 1/00* (2013.01); *D03D 13/004* (2013.01); *D10B 2401/20* (2013.01)

(58) Field of Classification Search
CPC ..... D03D 15/547; D03D 1/00; D03D 13/004; D03D 15/54; D03D 1/0011; D03D 15/47;
(Continued)

(56) References Cited

U.S. PATENT DOCUMENTS 4,009,512 A * 3/1977 Baba ..... D02H 5/02 28/191
4,364,157 A * 12/1982 Cutts ..... D06B 23/06 118/212

(Continued)

FOREIGN PATENT DOCUMENTS

JP 07092911 4/1995
JP 2003155639 5/2003

(Continued)

OTHER PUBLICATIONS

International Search Report—PCT/KR2021/008367 dated Oct. 12, 2021.

*Primary Examiner* — Robert H Muromoto, Jr.
(74) *Attorney, Agent, or Firm* — CANTOR COLBURN LLP

(57) ABSTRACT

Provided is a security fabric having improved security and identification properties, the security fabric comprising security threads containing a fluorescent material, which has an intrinsic light emission characteristic under excitation light, wherein the security threads are included in warp (Continued)

threads, weft threads, or warp and weft threads, and a set number of security threads are included per unit area.

11 Claims, 3 Drawing Sheets

(58) Field of Classification Search
CPC ..... D10B 2401/20; D02G 3/36; D06P 1/00; D06P 1/0012
See application file for complete search history.

(56) References Cited

U.S. PATENT DOCUMENTS 4,407,767 A * 10/1983 Seaborn ..... D02H 5/00 264/290.5
4,641,404 A * 2/1987 Seydel ..... D06B 23/06 28/186
4,921,280 A * 5/1990 Jalon ..... D06P 1/0012 283/88
5,824,393 A * 10/1998 Nakamura ..... D03D 15/54 428/688
5,941,572 A * 8/1999 Gundjian ..... D02G 3/346 283/67
6,068,895 A * 5/2000 Kimura ..... D03D 15/547 428/29
6,296,022 B1 * 10/2001 Lowe ..... D03D 1/0011 139/1 R
6,764,970 B1 * 7/2004 Kuoni ..... D03J 1/06 442/205
9,347,155 B2 * 5/2016 Terashima ..... G09F 3/0291
9,416,468 B2 * 8/2016 Bassi ..... D03D 13/004
10,087,574 B2 * 10/2018 Kismir ..... D03D 15/54
11,247,486 B1 * 2/2022 Herfindahl ..... B41J 15/16
2003/0093885 A1 * 5/2003 Inoue ..... A44B 18/0023 24/442
2008/0308172 A1 * 12/2008 Terashima ..... G09F 3/0292 428/199
2014/0033488 A1 * 2/2014 Terashima ..... G09F 3/0294 28/163

FOREIGN PATENT DOCUMENTS

| | | |
|---|---|---|
| JP | 2013170325 | 9/2013 |
| KR | 20070039473 | 4/2007 |
| KR | 100945471 | 3/2010 |
| KR | 100967087 | 7/2010 |
| KR | 101238197 | 2/2013 |
| KR | 20160069955 | 6/2016 |
| KR | 20160077612 | 7/2016 |
| KR | 102076059 | 2/2020 |

* cited by examiner

SECURITY FABRIC HAVING IMPROVED SECURITY AND IDENTIFICATION PROPERTIES

TECHNICAL FIELD

The present invention relates to a security fabric having improved security and identification properties, and more particularly, to a security fabric having improved security and identification properties capable of improving security and having identification properties by changing the content of a fluorescent material in a predetermined area.

BACKGROUND ART

Security materials may be required in areas where forgery prevention is required. For example, in a security printing field, the security materials have been used for securities such as checks, stamps, gift certificates, certificates, and bonds.

Recently, even in fiber products such as clothes and shoes, a need for forgery prevention technology through the security materials is emerging. Products made from fibers such as clothes and shoes are often used in real life, but recently, forgery cases are continuously emerging, and it is urgent to develop security fibers capable of solving this problem.

To solve this problem, security elements such as trademarks, for example, woven labels, and printed name labels are indicated, but these security elements are easily forged and can be made simply only with a sample, which has a disadvantage in that it is very difficult to be distinguished from a real thing.

Accordingly, in Korean Patent Registration No. 0945471, there are disclosed a security fluorescent yarn and a security paper employing the security fluorescent yarn, wherein in the security fluorescent yarn applied to the security paper, a first fluorescent material adheres to a position spaced apart from one end of the security fluorescent yarn having a predetermined length; the security yarn is extended from the other side of the first fluorescent material at a predetermined interval, a second fluorescent material adheres to the other end of the security yarn, and a plurality of first fluorescent materials and second fluorescent materials are formed at both sides of the security yarn to be spaced apart from each other at regular intervals. In Korean Patent Registration No. 0967087, there is disclosed a security paper with improved security, in which a fluorescence color fiber is manufactured by appropriately arranging invisible fluorescent pigments or near-infrared absorption pigments on the surface of a polyethylene terephthalate (PET) film, gravure printing fluorescent colors to be expressed, such as red, yellow-green, blue, and green, in the form of bands with widths of 0.5 mm to 0.75 mm at regular intervals for each color, and then finely cutting the fluorescent color bands in a perpendicular direction, thereby freely expressing a color of a single-stranded fluorescence color fiber. In Korean Patent Publication No. 2016-0077612, there is disclosed a security pattern sheet comprising a fluorescent print layer printed by using fluorescent print ink including fluorescent pigments; and a UV fluorescent matting layer stacked on the fluorescent print layer and printed by using ink for forming a security pattern, in which a security pattern image recognized by eyes under visible rays and a security pattern image recognized by the eyes under ultraviolet rays are different from each other.

As such, in the case of sheet-shaped security articles, since most techniques are techniques of including a fluorescent material used as a security material on a sheet and detecting the fluorescent material to determine a forgery, with the evolution of highly developed measuring equipment, there is a problem that the security element can be easily recognized from general equipment, and the recognized security element can be easily copied as it is.

Therefore, it is necessary to study a security article that not only prevents the recognition of the security element including the security material itself, but also cannot be copied so as to have the same security characteristics as the security element even if the security element is recognizable.

DISCLOSURE

Technical Problem

In order to solve the problems in the related art, an object of the present invention is to provide a security fabric having improved security and identification properties by forming a pattern in the fabric by security threads contained in a sheet-type security fabric to improve the security through the pattern.

Another object of the present invention is to provide a security article having improved security and identification properties in which the security fabric having improved security and identification properties of the present invention has identification by forming a deformable pattern to change the pattern according to a manufacturer, a seller, etc.

Technical Solution

The present invention provides a security fabric having improved security and identification properties including security threads containing a fluorescent material having an intrinsic light emission characteristic under excitation light, in which the security threads are included in warp threads, weft threads, or both warp and weft threads, and a set number of security threads are included per unit area.

The number of security threads included per unit area may be repeated in a set pattern.

The repetition of the patterns may be formed in a direction of warp threads or weft threads, or in directions of the warp threads and the weft threads.

The patterns may be repeated with 2 to 4 unit areas.

A boundary line of the unit area may be formed of boundary threads containing a fluorescent material having an emission wavelength in a visible band under excitation light.

The boundary line of the unit area may be formed of boundary threads as original threads.

The threads forming the inside of the unit area may be formed of SEMI DULL, and the boundary line of the unit area may be formed of FULL DULL.

The security threads may have 50% or more of an exposure frequency to one surface of the security fabric.

The security fabric having improved security and identification properties may further include second security threads containing a fluorescent material having an intrinsic light emission characteristic different from that of the security threads.

Advantageous Effects

According to the present invention, the security fabric having improved security and identification properties has an effect of improving security by forming a pattern according to the number of security threads per unit area contained in the fabric through the security threads contained in the sheet-type security fabric.

Further, the security fabric having improved security and identification properties has an effect of having identification by forming a deformable pattern to change the pattern according to a manufacturer, a seller, etc.

Further, it is possible to obtain an effect of having difficulty in forgery, excellent identification, and more improved security by applying different patterns according to a manufacturer, a seller, etc.

BEST MODE

Figure 1:
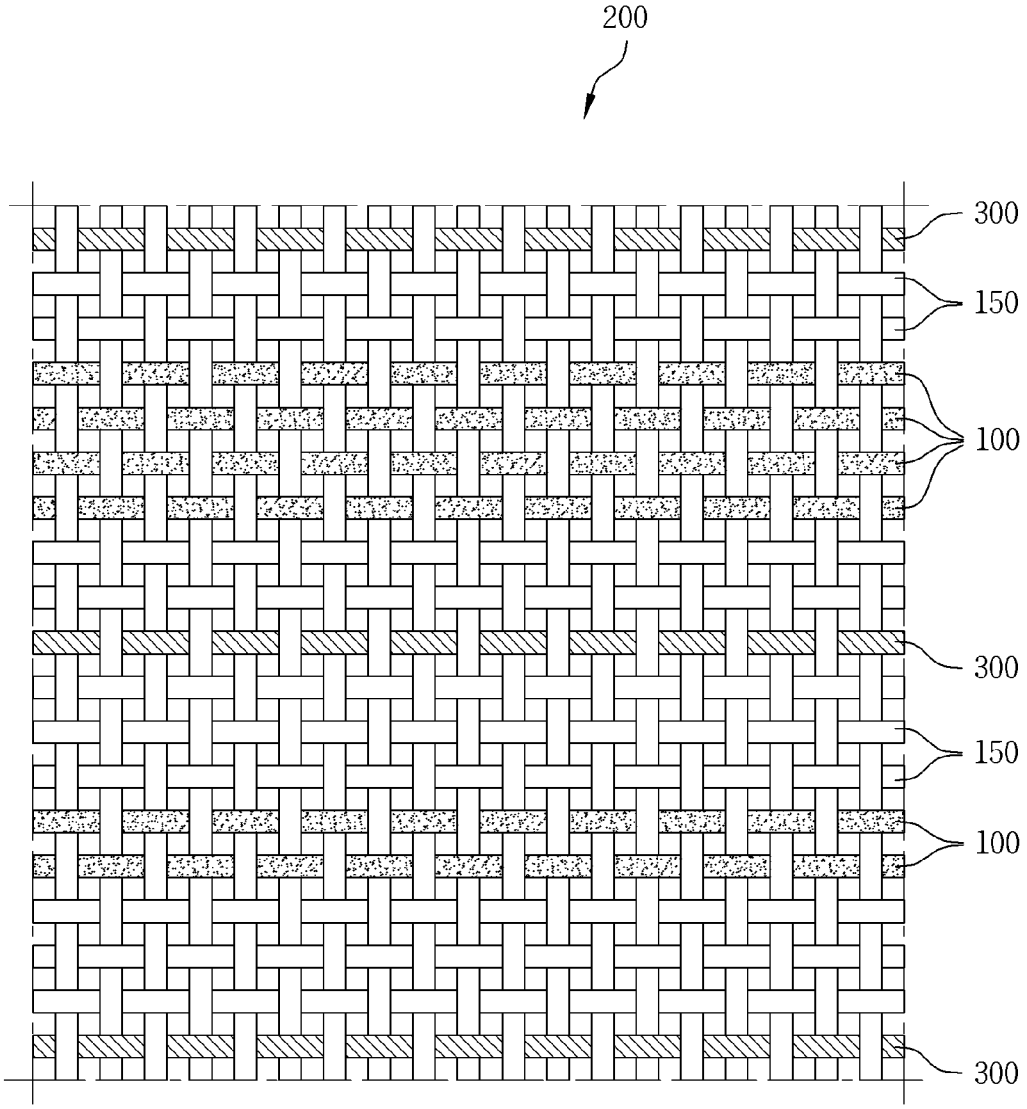
FIG. 1 is a diagram illustrating patterning using security threads on weft threads of a security fabric having improved security and identification properties.

Hereinafter, a preferred exemplary embodiment of the present invention will be described in detail with reference to the accompanying drawings. First, among drawings, it should be noted that like constituent elements or components are represented by like reference numerals. In describing the present invention, a detailed description of known functions and configurations incorporated will be omitted so as to avoid obscuring the gist of the present invention.

The terms "about", "substantially", and the like used herein are used as a numerical value or a value close to the numerical value when inherent manufacturing and material tolerances are presented in the stated meaning, and used to prevent an unscrupulous infringer from unfairly using disclosed contents in which precise or absolute numerical values are mentioned to help in the understanding of the present invention.

The present invention is an invention using a fluorescent material having an intrinsic light emission characteristic under excitation light, in which the fluorescent material may use a fluorescent material having an emission wavelength in an invisible band or a fluorescent material having an emission wavelength in a visible band.

In the case of using the fluorescent material having the emission wavelength in the invisible band, there is an advantage in that not only it is difficult to recognize a security element through a security article, but also it is possible to distinguish and verify an authentic security element from a copied/forged security element with high accuracy even if the security element can be recognized. In the case of using the fluorescent material having the emission wavelength in the visible band, there is an advantage in that it is possible to allow a user to increase recognition of an authentic product by recognizing visually the security element of the security article and to reduce illegal production attempts due to difficulty of copying/forgery.

The "intrinsic light emission characteristic" refers to characteristics of intrinsic emission wavelength, emission intensity, afterglow pattern, and afterglow emission time (emission lifetime) for each fluorescent material.

In this specification, the "emission wavelength in the invisible band" may mean emitting light with a wavelength other than a visible light wavelength, and for example, may mean emitting light with a wavelength of an infrared band and/or an ultraviolet band. At this time, it should not be interpreted that the "emission wavelength in the invisible band" may mean emitting light only in a wavelength band without wavelengths corresponding to visible light (380 to 780 nm), and it may be interpreted as emitting light with a wavelength of light in a band that is practically indistinguishable to the human eyes. The "emission wavelength in the visible band" means that the emission wavelength includes wavelengths of a wavelength band corresponding to visible light (380 to 780 nm).

As used herein, the "fluorescent material having the emission wavelength in the invisible band" or "fluorescent material having the emission wavelength in the visible band" refers to a fluorescent material having a specific emission wavelength under excitation light. In this case, when the excitation light is not irradiated, the light is not generally emitted at the wavelength, but the fluorescent material has or includes an afterglow and the like after irradiation with the excitation light.

It is preferred that a security product containing the "fluorescent material having the emission wavelength" is not distinguished from general products without containing the fluorescent material with the human eyes.

Either the fluorescent material having the emission wavelength in the invisible band or the fluorescent material having the emission wavelength in the visible band may be used when satisfying conditions of the present invention. For example, as the fluorescent material having the emission wavelength in the invisible band, $SrB_4O_7$:Eu, $Y_3Fe_4InO_{12}$:Er, and invisible luminous bodies disclosed in Korean Patent Nos. 1238197 and 1599808 may be used, and as the fluorescent material having the emission wavelength in the visible band, $Y_2O_3$:Eu, $Y_2O_2S$:Tb, $Zn_2SiO_4$:Mn, $Y_3Fe_4InO_{12}$:Er, and PANAX RED LR-770, PANAX YELLOW-550, PANAX BLUE PKS-245, PANAX LG-880 manufactured by Ukseung Co., Ltd. may be used.

Figure 2:
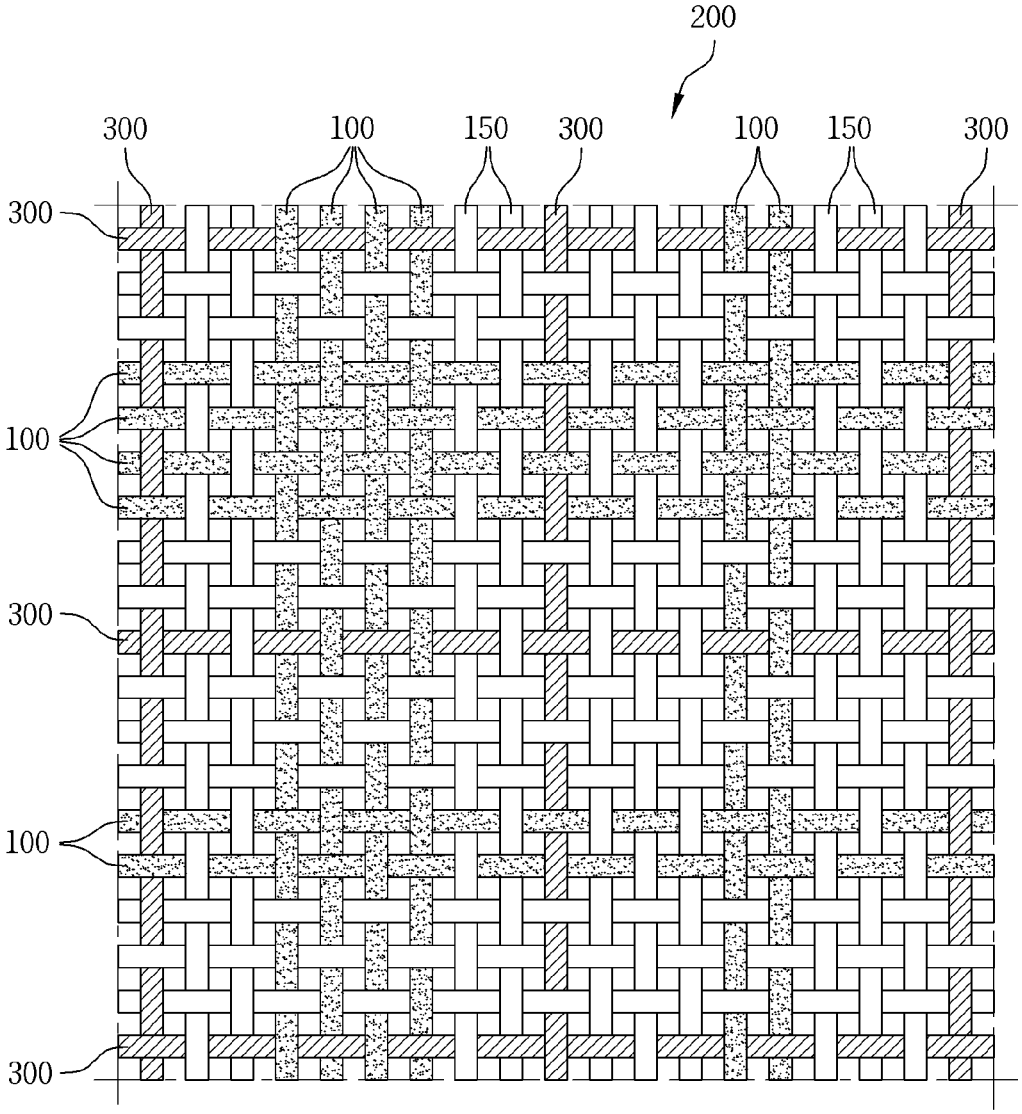
FIG. 2 is a diagram illustrating patterning using security threads on warp threads and weft threads of the security fabric having improved security and identification properties.
Figure 3:
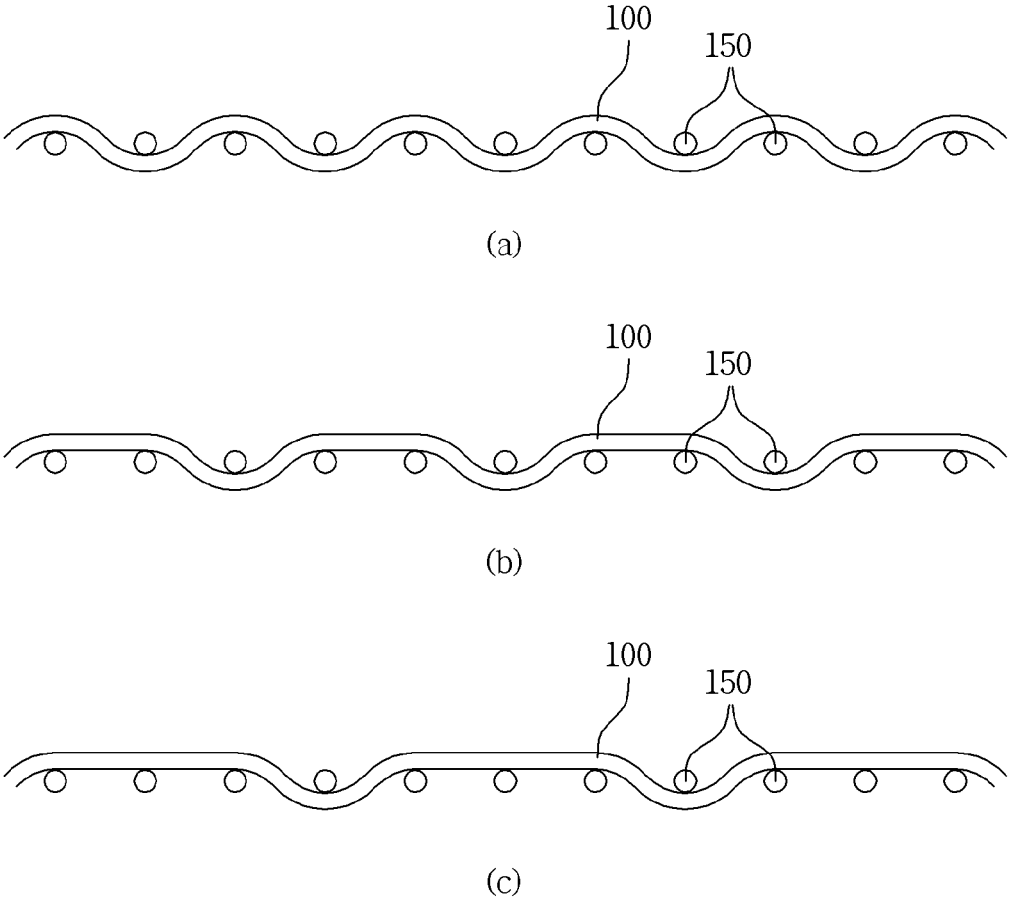
FIG. 3 is a diagram illustrating a form of exposing security threads of the security fabric having improved security and identification properties.

FIG. 1 is a diagram illustrating patterning using security threads on weft threads of a security fabric having improved security and identification properties, FIG. 2 is a diagram illustrating patterning using security threads on warp threads and weft threads of the security fabric having improved security and identification properties, and FIG. 3 is a diagram illustrating a form of exposing security threads of the security fabric having improved security and identification properties.

The present invention provides a security fabric 200 including security threads 100 containing a fluorescent material having an intrinsic light emission characteristic under excitation light, as illustrated in FIGS. 1 and 2.

The security fabric 200 is formed of the security threads 100 containing the fluorescent material and general threads 150 without containing the fluorescent material.

The security threads 100 are may be included in warp threads, weft threads, or both warp and weft threads, and a set number of security threads may be included per unit area.

The number of security threads 100 included per unit area may be patterned by designing the fabric to be repeated in a set pattern.

The security threads 100 may be prepared by spinning the threads containing the fluorescent material in a master batch by containing a fluorescent material or may also be formed by coating the fiber with a coating solution containing the fluorescent material, and the fluorescent material may be included in a security sheet by various methods.

When the security threads are used as a synthetic fiber or regenerated fiber, it is preferable to form the security threads in the master batch by containing the fluorescent material, and when used as a natural fiber, it is preferable to form the security threads by coating and containing the fluorescent material.

When forming the security threads by a spinning method, the security threads may be formed of multi-filament threads, but if the content of the fluorescent material is increased to enhance the sensitivity of the security threads, thread cutting may occur in the spinning process and the workability may deteriorate. Accordingly, the security threads may be formed of mono-filament threads to increase the content of the fluorescent material, thereby improving the workability.

Alternatively, the security threads may be formed of short fibers and then formed into spun threads to be used in various products while increasing the content of the fluorescent material.

The unit area included in the set number of security threads is set to an arbitrary size at the time of designing the fabric, and a detection size of a detector may be set to the size of the unit area so that the unit area may be detected at once with the detector.

As illustrated in FIG. 1, when the security threads are included only in the weft threads, the repetition of the patterns is formed in a direction of the warp threads, and when the security threads are included in the warp threads, the repetition of the patterns is formed in a direction of the weft threads.

In addition, when the security threads are included in both the warp threads and the weft threads, the repetition of the patterns is formed in directions of the warp threads and the weft threads, so that emission characteristics are varied depending on a unit area, making it difficult to be forged.

The repetition of the patterns is formed in the directions of the warp threads and the weft threads to lower a possibility of forgery, but since the content of the security threads is high, economic feasibility may be lowered, so that it should be designed by appropriately adjusting the content of the security threads according to the use and purpose of the product.

The repeated sections of the patterns may be set to two or more unit areas by a design of the fabric, but it is preferable to repeat the patterns with 2 to 4 unit areas for the convenience of sensing.

Although the unit area may be set without a separate distinction, it is preferable to form boundary threads 300 on a boundary surface of the unit area so as to recognize the unit areas as illustrated in FIGS. 1 and 2 in order to increase the detection convenience.

As the method capable of recognizing the unit areas, a boundary line of the unit area may be formed by boundary threads 400 containing a fluorescent material having an emission wavelength of a visible band under excitation light so that the detector may confirm the unit area under the excitation light.

Alternatively, the boundary line of the unit area may be formed by the boundary threads as original threads, thereby easily distinguishing the unit areas.

Alternatively, the threads forming the inside of the unit area are formed of SEMI DULL, and the boundary line of the unit area may distinguish the unit area due to a difference in luster of the security fabric by using the boundary threads of FULL DULL.

It is most preferred to recognize the unit area by using the boundary threads containing the fluorescent material having the emission wavelength in the visible band under the excitation light so as not to be visually distinguishable usually in order to lower the possibility of forgery.

As such, since the security fabric of the present invention with security and identification may design various patterns by patterning a difference in the content of the security threads according to a unit area, the patterns may be varied depending on a plurality of manufacturers, sellers, etc., or the patterns may be varied depending on a product, thereby further enhancing the security.

As an example, as illustrated in FIG. 1, when the security threads are included in the weft threads and the security threads are formed with 4, 2, 4, 2 patterns per unit area, the patterns are repeated in two unit areas, and the repetition of the patterns is formed in the direction of the warp threads.

As another example, as illustrated in FIG. 2, when the security threads are included in the warp threads and the weft threads and the security threads are formed with 4, 2, 4, 2 patterns per unit area in the warp threads and the weft threads, the patterns are repeated in four unit areas of 2×2, and the repetition of the patterns is formed in the directions of the warp threads and the weft threads.

As such, the security fabric of the present invention enables various patterns by using the security threads in warp threads, weft threads, or both the warp threads and the weft threads and controlling the content of the security threads per unit area.

The security fabric having improved security and identification properties of the present invention is a fabric formed by intersecting warp threads and weft threads, and as illustrated in FIG. 3A, when the fabric structure is formed as a plain fabric, the exposure frequency of the warp threads or weft threads on one side of the fabric may be 50%.

In order to enhance the sensitivity to the security threads of the security fabric having improved security and identification properties of the present invention, it is preferred to design the fabric as illustrated in FIGS. 3B and 3C so that the security threads 100 are exposed more than the general threads 150 to one surface of the security fabric.

As illustrated in FIGS. 3B and 3C, it is preferred that the exposure frequency of the security threads 100 is increased to form the exposure frequency of the security threads to one surface of the security fabric at 50% or more.

In addition, in order to further improve the security of the security fabric having improved security and identification properties of the present invention, the security fabric may further include second security threads containing a fluorescent material having an intrinsic light emission characteristic different from that of the security threads.

The second security threads are preferably included in a set number per unit area like the security threads, and the number included per unit area is preferably repeated in a set pattern.

Through the security threads and the second security threads, the security fabric of the present invention may be designed with more various patterns, thereby further improving the security and identifying users of manufacturers, sellers, etc.

As such, the security fabric having improved security and identification properties of the present invention may sense the emission characteristics of the fluorescent material included in the security fabric by a detector and a detection method including an emission unit for emitting light, a reception unit for receiving a signal emitted from the emission unit and emitted from the fluorescent material, and a control unit for determining the authenticity of a detection target based on the signal received by the reception unit, as disclosed in Korean Patent Registration No. 2076059.

As described above, it is possible to determine the authenticity of the product by sensing an intrinsic light emission characteristic emitted from the fluorescent material included in the unit area through the detector.

In addition, it is possible to identify manufacturers, sellers, etc. through the patterns of the unit area, and it is possible to further improve sensing efficiency, security, and identification properties by storing the patterns of the unit area of the users of each manufacture or seller in the detector.

The invention claimed is:

1. A security fabric having improved security and identification properties, the security fabric comprising:

two or more boundary threads spaced apart from each other and defining a unit of area in-between; and a predetermined number of first security threads included within the unit of area, the first security threads containing a first fluorescent material having an intrinsic light emission characteristic under excitation light and forming a predetermined pattern within the unit of area, wherein the security threads are included in warp threads, weft threads, or both warp and weft threads; wherein the two or more boundary threads include at least three horizontal boundary threads parallel to and spaced apart from each other, and at least three vertical boundary threads parallel to and spaced apart from each other, the at least three horizontal boundary threads and the at least three vertical boundary threads defining at least 4 units of area.

2. The security fabric having improved security and identification properties of claim 1, wherein the predetermined pattern is different from a pattern included in a neighboring unit of area.

3. The security fabric having improved security and identification properties of claim 1, wherein the predetermined pattern is formed in a direction of warp threads or weft threads, or in directions of the warp threads and the weft threads.

4. The security fabric having improved security and identification properties of claim 1, wherein the two or more boundary threads contains a second fluorescent material having an emission wavelength in a visible band under excitation light.

5. The security fabric having improved security and identification properties of claim 1, wherein the first security threads have 50% or more of an exposure frequency to one surface of the security fabric.

6. The security fabric having improved security and identification properties of claim 1, further comprising:

a predetermined number of second security threads containing a second fluorescent material having an intrinsic light emission characteristic different from that of the first security threads, wherein the first security threads and the second security threads form the predetermined pattern.

7. The security fabric having improved security and identification properties of claim 1, wherein the predetermined pattern is different from a pattern included in a neighboring unit of area.

8. The security fabric having improved security and identification properties of claim 1, wherein the predetermined pattern is formed in a direction of warp threads or weft threads, or in directions of the warp threads and the weft threads.

9. The security fabric having improved security and identification properties of claim 1, wherein the at least three horizontal boundary threads and the at least vertical boundary threads contain a second fluorescent material having an emission wavelength in a visible band under excitation light.

10. The security fabric having improved security and identification properties of claim 1, wherein the first security threads have 50% or more of an exposure frequency to one surface of the security fabric.

11. The security fabric having improved security and identification properties of claim 1, further comprising:

a predetermined number of second security threads containing a second fluorescent material having an intrinsic light emission characteristic different from that of the first security threads, wherein the first security threads and the second security threads form the predetermined pattern.

* * * * *